United States Patent [19]

Sappington

[11] Patent Number: 5,072,716

[45] Date of Patent: Dec. 17, 1991

[54] ARCHERY BOW SIGHTING DEVICE

[75] Inventor: Donald R. Sappington, St. Charles County, Mo.

[73] Assignee: Toxoric, Inc., O'Fallon, Mo.

[21] Appl. No.: 560,353

[22] Filed: Jul. 30, 1990

[51] Int. Cl.[5] ..... F41B 5/00

[52] U.S. Cl. ..... 124/87; 33/265

[58] Field of Search ..... 124/87, 88, 86; 33/265

[56] References Cited

U.S. PATENT DOCUMENTS

| | | | |
|---|---|---|---|
| 3,579,839 | 5/1971 | Kowalski | 33/265 |
| 4,535,747 | 8/1985 | Kudlacek | 33/265 X |
| 4,669,196 | 6/1987 | Kersey | 33/265 |
| 4,875,290 | 10/1989 | Finch | 33/265 |
| 4,910,874 | 3/1990 | Busch | 33/265 |
| 4,995,166 | 2/1991 | Knemeyer | 33/265 |

*Primary Examiner*—Peter M. Cuomo
*Assistant Examiner*—Jeffrey L. Thompson
*Attorney, Agent, or Firm*—Paul M. Denk

[57] ABSTRACT

A sighting device for use in conjunction with an archery bow to facilitate the accurate sighting in of a target, the sighting device mounts laterally or to the bow, by means of an adjustable support arm, the support arm fixes a first mount, that secures a slide, to provide either lateral or vertical adjustment to the sight, an indexing means to provide for fine setting to the slide within its mount, and second mount secures to the first slide, and has a second slide provided therein, for holding of the sight pins, to provide for the other of the vertical or lateral adjustment to the pins when achieving accuracy in the setting of the sight in preparation for usage and application of the archery bow.

2 Claims, 3 Drawing Sheets

ARCHERY BOW SIGHTING DEVICE

BACKGROUND OF THE INVENTION

This invention relates generally to a sighting device for use with an archery bow, and in this particular development, provides for enhanced usage, application, and greater fine and accurate setting in the adjustments made to the sight during usage and application of the archery bow by the hunter, as during target practice, hunting, and the like.

There are a great variety of sighting means available in the market, and for use with the archery bow, the construction of these devices generally focusing on select aspects of sighting, such as adjustments to the various pins that extend laterally of the bow, and which when adjusted, provide for the degree of elevation that must be made to the bow, and the arrow, during sighting, to assure that there is taken into consideration the wind and gravitational effects when the arrow is shot. These types of sighting devices are very numerous in number, readily available in the art, as can be seen in the various archery publications that are readily available, and in a variety of United States patents. For example, the prior United States patent of the current inventor, U.S. Pat. No. 4,819,611, shows such a sighting device, which in this particular instance incorporates flexible pins. In addition, a patent owned by the assignee of the current invention, U.S. Pat. No. 4,557,076, discloses another bow sight, that has various adjustment means cooperating in its structure to provide and facilitate means for adjustment, at least along one dimension, or through rotational adjustment, of the sighting device. This device includes the use of a spring loaded detent for regulating the vertical adjustment.

Various other sight and guide devices for use in conjunction with an archery bow, in the sport of archery, are shown in the Little U.S. Pat. No. 4,587,945, the Saunders U.S. Pat. No. 4,584,777; the Larson U.S. Pat. Nos. 4,305,208, and 3,696,517; the Stebbins U.S. Pat. No. 3,670,422; the Egan U.S. Pat. No. 3,477,130; the Kernan U.S. Pat. No. 3,475,820; the Roloff, et al, U.S. Pat. No. 3,389,695; the Stebbins U.S. Pat. No. 3,136,063; the Kocur U.S. Pat. No. 2,767,472; the Steiber U.S. Pat. No. 2,574,599, and various other patents and publications in the art.

SUMMARY OF THE INVENTION

The principal object of this invention is to provide a sighting device that incorporates means for furnishing not only adjustment, but a fine regulation in the settings, both laterally and vertically, to the sighting pins used in conjunction with a sight incorporated onto an archery bow.

As is well known in the art, sight pins for use upon an archery bow are set in advance, generally through the process of trial and error, in order to establish variations in the elevation provided to the bow with respect to known distances within the range of the projected arrow. Once established, the pins are locked in place, ready for the hunting field. The current invention takes the entire process one step further, and provides means for facilitating even the temporary set to the pins, before they are permanently locked in place for the hunt.

This invention contemplates the structural assembly of a sighting device that incorporates a support arm which is adjustably affixed to an archery bow, at the normal position where such sighting devices are incorporated, and within the line of sight of the archer, when employing the bow for target practice, hunting, and various other uses and application. The support arm is held by a fastening means generally a slide mount, to the bow, but which can be loosened to provide for adjustment in the forward and rearward locations dimentionally in front of the bow for the sighting device, and more specifically its arranged sight pins, usually with respect to the frontal edge of the supporting bow. The support arm, at its other end, has affixed thereto a mount, and which mount includes means for supporting a slide, and which slide can be two dimensionally slid with respect to the mount, to furnish either a vertical or lateral rearrangement to the slide, with respect to the bow, to provide for corresponding adjustment in the arranged sight pins with respect to the bow structure. In addition, indexing means is provided in conjunction with this mount, and which when manipulated, provides for the fine regulation in the degree to which the slide is linearly shifted during its adjustment. The slide has connected to it another mount, and which second mount cooperates with an additional slide, so that lineal shifting of the sighting device can be made in the second dimension, the other of the vertical or lateral shift, in order to provide for the compound shifting of the supported sight pins, both in a horizontal or lateral direction, with respect to the bow, in addition to their vertical adjustment. The second slide incorporates mechanism for mounting of the sighting pins, so that the pins can be adjusted through the manipulation of the various indexing means that are operatively associated with both the first and second mounts, that furnish fine adjustment both vertically and laterally to the sight pins, in their arrangement along the frontal portion of the archery bow. The sight pins, as usual, may include a guard therearound, to protect them in their adjustment and setting, and to prevent any impacting force, such as when the bow might be carried, laid down, carried through brush and the woods, or the like, and to prevent a throwing off of the pins in their previously precise settings. In addition, the individual sight pins may be readjusted in their initial setting, in order to provide for the proper ranges in the degree of their setting made through the sighting device in order to compensate for distance, windage, strength of the bow, and the like, during application and usage of the archery bow. These pins may be individually supported, by adjusting screws, to provide for their initial setting, or, in the alternative, the invention further envisions means, incorporating magnetic structure, that holds the pins once initially set, until such time as clamping means may be tightened in order to affix the pins into their precise setting, in preparation for the undertaking of the further fine regulation through the indexing means of this invention, for attaining both vertical and lateral adjustment to the sighting pins, in final preparation for usage of the archery bow.

It is, therefore, an object of this invention to provide a sighting device that incorporates multiple, but cooperating, mount supported slide means for furnishing a variety of movements to the sight pins of the sighting device during its adjustment and usage.

Another object of this invention is to provide indexing means for finely regulating the shifting of the sighting pins during their accurate adjustment during sighting of the archery bow, said adjustment capable of being made along the horizontal, vertical and forward dimensions.

Still another object of this invention is to provide adjusting means cooperating with the support arm that holds the entire sighting device to the archery bow.

Still another object of this invention is to provide means for provision of an individual adjustment to the sighting pins when being manipulated into their focused positioning.

Yet another object of this invention is to provide the usage and application of magnetic means, in cooperation with a clamping means, to temporarily support the pins when initially set, in preparation for their final adjustment.

These and other objects may become more apparent to those skilled in the art upon reviewing this summary of the invention, and upon undertaking a study of the description of the preferred embodiment, in view of the drawings.

BRIEF DESCRIPTION OF THE DRAWINGS

In referring to the drawings, FIG. 1, provides a phantom line view of an archery instrument having the sighting device of this invention affixed for extending forwardly of its said bow.

DESCRIPTION OF THE PREFERRED EMBODIMENT

Figure 1:
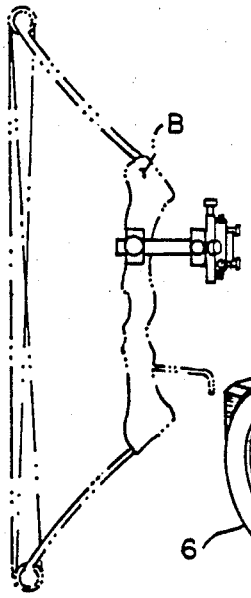
Figure 2:
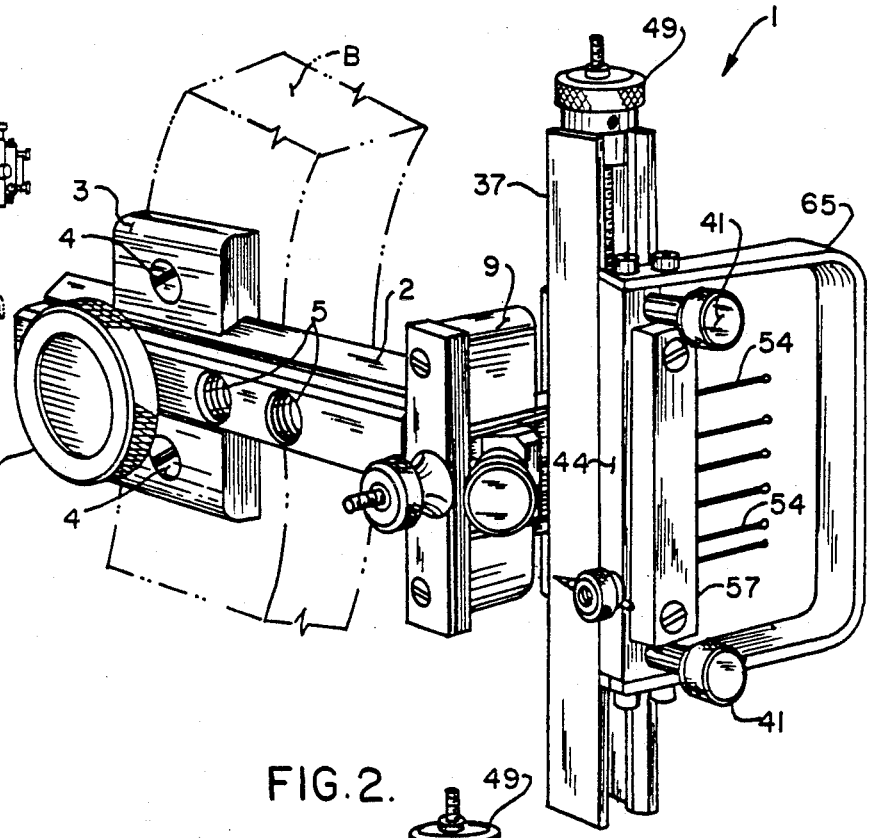
FIG. 2 provides an isometric view of the sighting device of this invention, as mounted to the side of the archery bow.
Figure 3:
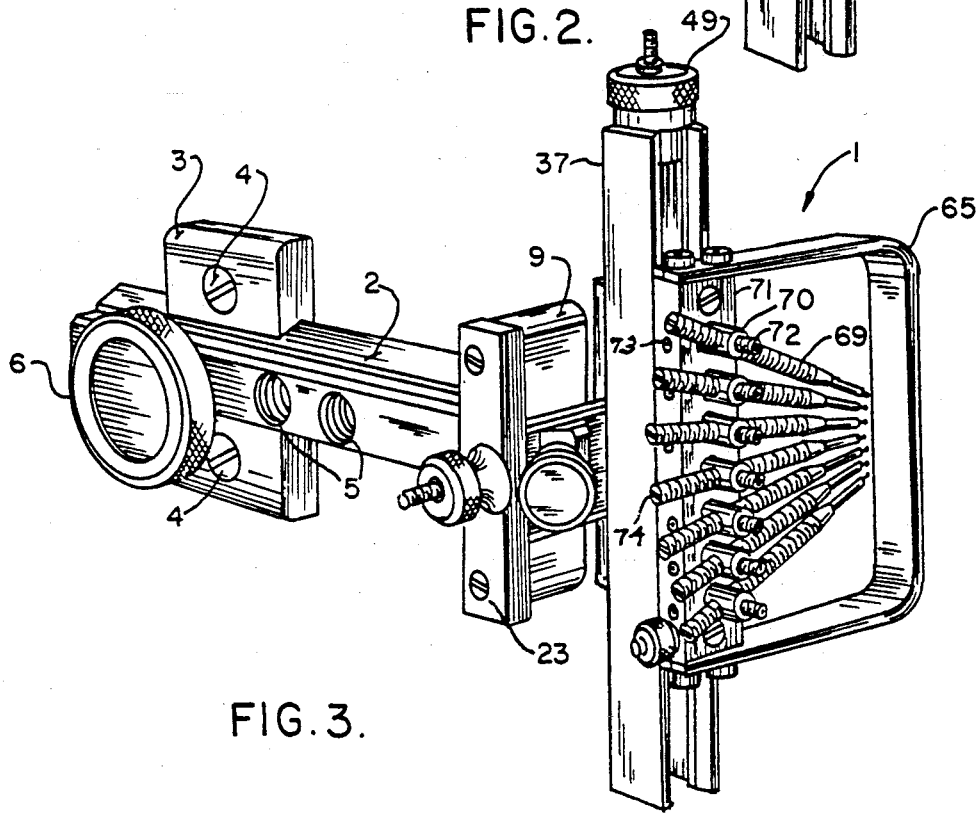
FIG. 3 is an isometric view of a modification to the sighting device of this invention.
Figure 4:
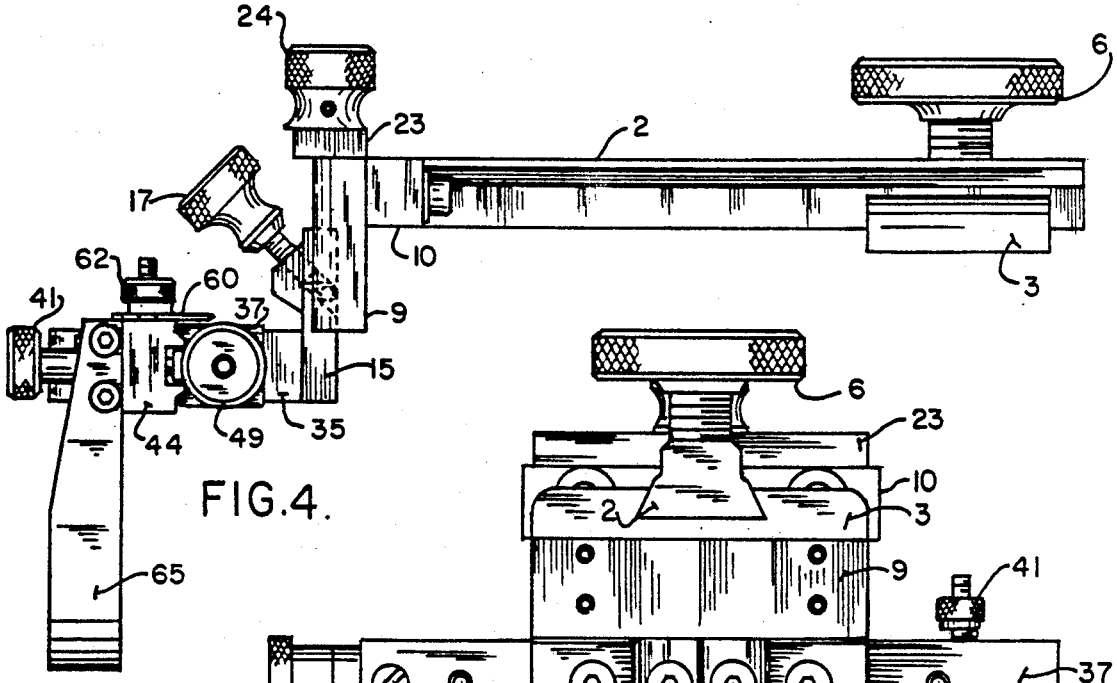
FIG. 4 is a top view of the sighting devices as shown in FIGS. 2 and 3.
Figure 5:
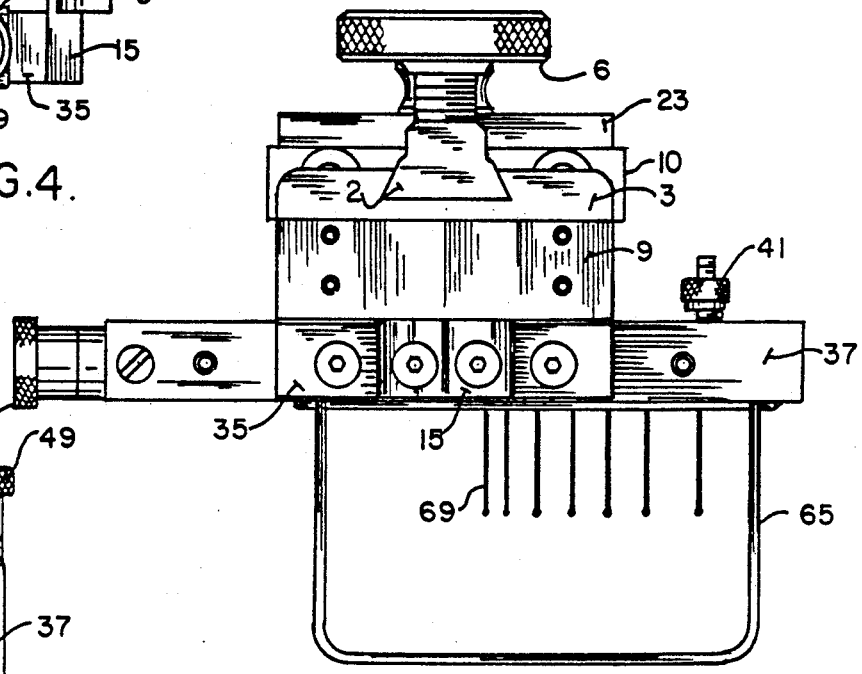
FIG. 5 is a front view of the sighting device shown in FIG. 2.

In referring to the drawings, and in particular FIGS. 1 through 3, the bow sight 1 of this invention, in its various modifications, is shown therein More specifically, the bow sight is designed for mounting to the structure of the bow B itself, as can be noted in FIGS. 1 and 2. The sight extends some distance forwardly of the bow, as noted, and its sighting means extends laterally thereof, generally in front of the bow and to its left side thereof, in order to provide adequate alignment for the archer in utilizing the sight pins when lining up a target for a shot. Obviously, the sight of this invention may be used in this manner for a right-handed archer, whereas, if a left-handed archer is making use of the apparatus, the sight may be mounted to the other side, or the left side, of the bow, in a reverse position from that as shown in FIGS. 1 and 2, and still be just as effective in application.

Each of the bow sights 1 in FIGS. 2 and 3 includes a support arm 2, which is received within a mount 3 and which mount is rigidly fastened by means of the fasteners, such as the screws 4, to the side of the bow, as noted. The support arm includes a series of aligned apertures, as at 5, provided therethrough, there being four in number, as can also be seen in FIG. 7, and each of these apertures are threaded, as noted, and are disposed for reception of a screw 6, that includes an enlarged knurled knob, as can be seen, in order to provide for securement of the support arm to its mount 3, when fastened in position, and arranges the sighting means at a fixed distance forwardly of the bow, as can be noted. As can also be seen in FIG. 7, the mount 3 likewise includes an aperture, as at 7, provided therethrough, and the integral pin 8 of the fastening screw 6 extends through said aperture for fixing the support arm with respect to its mount, as can be understood.

Figure 7:
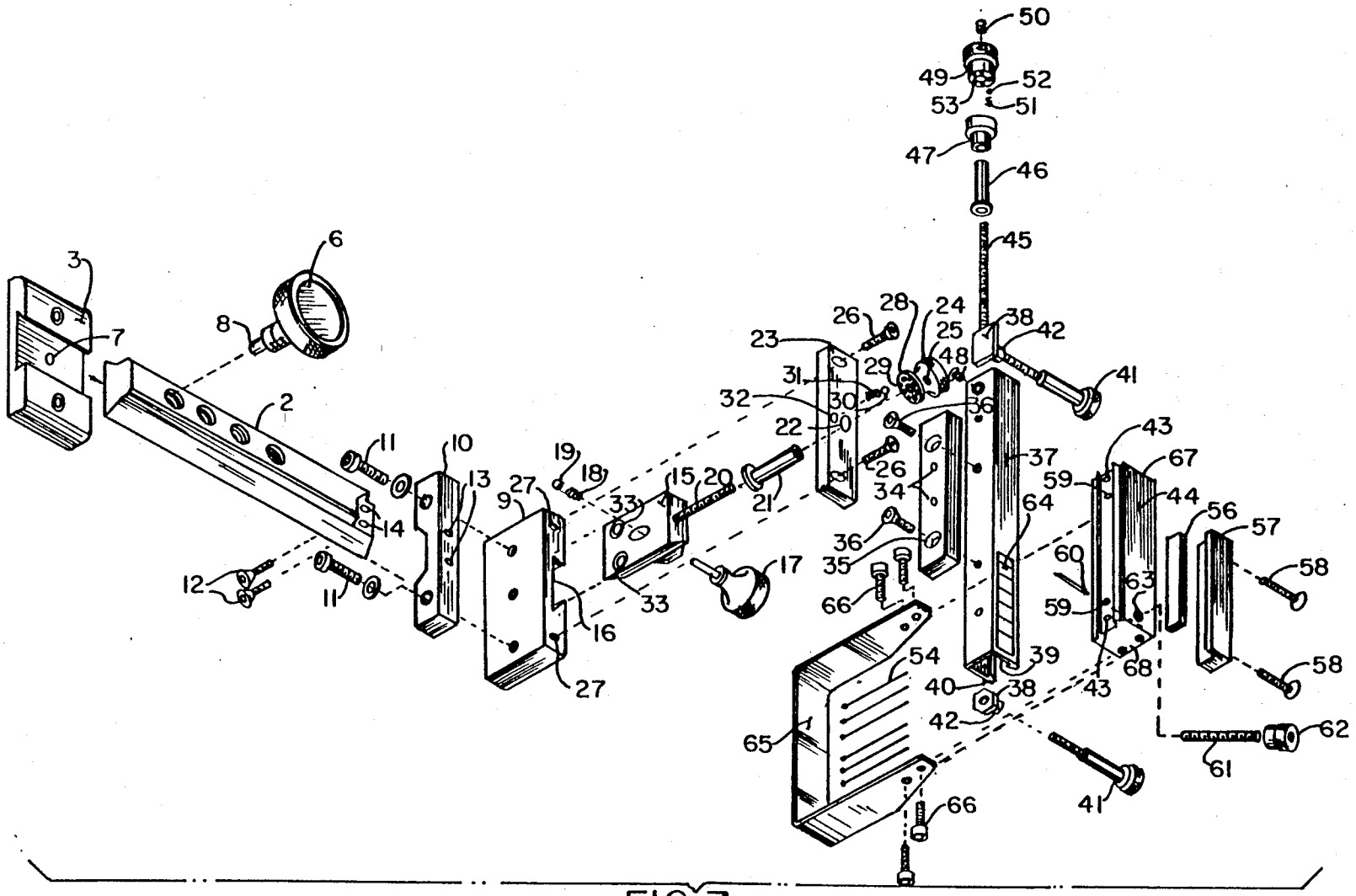

A further mount 9 is rigidly secured to the front end of the support arm 2, and this is achieved through the use of a brace 10, as can be seen in FIG. 7, which threadily engages rigidly to the mount 9, through the use of a series of fasteners 11, and said brace is likewise secured by means of the fasteners 12 extending through the apertures 13 of said brace for being fixed to the end of the support arm, by means of the fasteners tightening into the apertures 14, as noted. A lateral slide 15 is arranged for shifting within the groove 16 provided within the mount 9, and the slide 15, in this case a lateral slide, may be fixed into position when adjusted within the groove 16, of the mount 9, by means of a retention screw 17 that compresses by means of a spring 18 and a detent 19 against the inner surface of the groove 16, to lock the slide 15 in place, once set. This is done after the slide 15 has conveniently and properly adjusted, laterally, the bow sight, into its properly set disposition. Generally, the type of setting is made to take care of windage.

One of the aspects of this invention is to provide means for furnishing a form of indexing, to provide for a more accurate setting in the bow sight, when initially adjusted. As can be seen in FIG. 7, the lateral slide 15 has a screw 20 extending from one end. Disposed for threadily engaging upon the screw 20 is a threaded sleeve 21, which extends rotationally through an aperture 22 provided within a retainer 23. The opposite end of the threaded sleeve 21 extends into a turn nut 24, and can be fixed therein by means of a set screw (not shown) that threadily engages through the aperture 25, as can be seen. The retainer 23 is designed for fixed securement to the side of the lateral mount 9, by being secured by its fasteners 26 extending through the retainer 23, and fastening into the apertures 27 provided on an edge of the lateral mount 9, as noted. The adjusting nut 24, on its inner flared surface 28 has a series of circumferentially arranged positioning slots or detents 29, as can be noted, and are designed for engagement selectively, by a detent ball 30, biased by a spring 31, both of which seat within an aperture 32 provided within the retainer 23. Thus, as the adjustment nut 24 is turned, and the detent ball engages within the variety of slots 29, the lateral slide 15, through the threaded engagement between the threaded sleeve 21 and the turn screw 20, is urged to one side or the other, within the slot 16 of the mount 9, to provide for a lateral fine adjustment to the bow sight, during its setting.

The means for providing the vertical adjustment to the bow sight, as generally disclosed in FIGS. 2 and 3, can likewise be more accurately depicted in view of FIG. 7. At the approximate left end of the slide 15 are a pair of apertures 33. Threaded fasteners, not shown, extend through said apertures 33 and threadily engage within the apertures 34 provided within the brace 35. The brace 35 secures by means of the fasteners 36 to the vertical mount 37. A pair of slide means 38 are designed for riding within the mount 37, within its grooved interior, as at 39, and are held therein by means of the inturned edges, as at 40, integrally formed within the vertical mount 37. A pair of screws 41 threadily engage within the integral shanks 42 of the slide means 38. These screws also extend through the apertures 43 provided within the vertical slide 44, so that when the screws 41 are inserted through the apertures 43, and threadily engage within the shanks 42, but are not tightened, the slide 44 is free for shifting vertically within the vertical mount 37, as can be understood. But, when the screws 41 are tightened, within the threaded shanks 42, they bind the slide 44 with respect to the vertical mount 37, into its fixed disposition. To achieve precise setting of the slide 44 with respect to the vertical mount 37, a threaded screw 45 extends from the upper slide means 38, and is disposed for threaded engagement with the threaded sleeve 46, as shown. The threaded sleeve 46 rotatably extends through he bearing 47, which is fixed to the upper end of the vertical mount 37, by means of the set screw 48. The upper end of the threaded sleeve 46 extends into the adjustment nut 49 and is fixed into position by means of a set screw 50, that secures therein, and tightens against the upper proximate end of the threaded sleeve 46. Thus, the threaded sleeve 46, as tightened within the adjustment nut 49, is free for turning about the bearing 47, and in doing so, either draws in, or extends out, depending upon the direction of their turn, the threaded screw 45, and in doing so, either lowers or raises the slide means 38, within the vertical mount 37. A spring 51 and detent ball 52 mount within the bearing 47, within an aperture (not shown), with the ball biasing against and into one of the circumferentially slots, or detent seats, as at 53, in order to provide for indexing in the turn of the adjustment nut 49, and the setting given to the upper slide means 38, in addition to the slide 44, when accurately adjusting, vertically, the bow sight of this invention.

Figure 6:
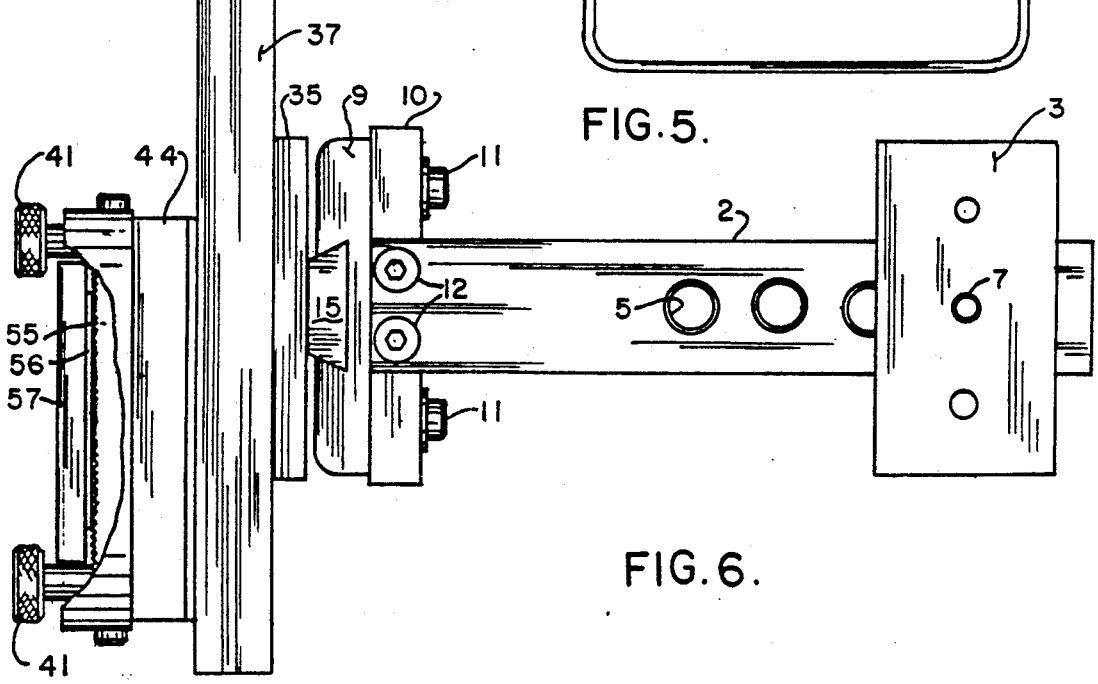
FIG. 6 is a left side view of the sighting device as shown in FIG. 2; and, FIG. 7 is an exploded view of the sighting device as disclosed in FIG. 2.

One form of bow sight in this invention is shown in FIG. 2, wherein a series of sighting pins, as at 54, are shown, and which are prepositioned, and targeted, so as to provide proper elevation to be given to the bow, when sighting upon a target at a select distance, in the manner as well known in the art of archery. One feature of this invention, and which is the preferred embodiment, is to provide means for preliminarily adjusting these pins, within the sight, before they are fixed into position, and before the vertical, and even lateral, adjustments are made to the sight with respect to the sighting pins. This is achieved in the following manner. As can also be seen in FIG. 6, the frontal surface of the slide 44 has a knurled or grooved configuration, as noted at 55. The pins, as at 54, are designed for resting upon that grooved surface, and are preliminarily held into position by means of a strip of magnetized material, such as doped polymer or rubber, as shown at 56. Once the pins are adjusted into their desired position, a clamping means 57 is secured thereon, by means of a pair of fasteners 58, which threadily engages within the apertures 59 provided through the slide 44. Thus, the magnetized means 56 holds the pins into the preliminarily adjusted position, and once achieved, the clamping means 57 is secured permanently into its fixed position.

One additional feature is provided to further assure accuracy in the setting and final adjustment of the bow sight, and more specifically its slide 44 within its vertical mount 37, of this device. An indicating needle 60 is held by means of a threaded screw 61 and its fastening nut 62, the screw being threadily engaging within the aperture 63 of the slide 44. When tightened therein, the indicator needle 60 is arranged laterally of the vertical mount 37, and becomes aligned with the indicator scale 64 provided to the side of the said vertical mount 37. Thus, previously determined graduations provided upon the scale 64 facilitate the adjustments made to the vertical aspects of this bow sight, when it is being finally adjusted into its more precise setting. Or, the graduation can be made and marked simultaneously with a current setting.

As can also be seen, a pin guard 65 is secured by its various fasteners, as at 66, to the upper and lower surfaces 67 and 68, respectively, by means of the fasteners threadily engaging within apertures provided thereat, as can be noted.

An alternative to the bow sight of this invention can be seen in FIG. 3, wherein the sight pins 69, rather than being held by any form magnetized clamp means, as previously explained with respect to FIGS. 2, 5, 6, and 7, simply have a series of adjusting mounts or adjustable turrets, as at 70, through which each pin inserts, and then are held fixed in position against the frontal surface of the slide means 71, which is similar in disposition to that as previously explained with respect to the slide means 44, and with each pin, when adjusted, being locked into position by means of the set screw 72. Each pin is movable for pivoted vertical adjustment by loosening of the screws 73, while simultaneously each pin is horizontally or laterally adjustable through the loosening of the said individual screws 72. The pins are threadedly inserted within each turret 70, and can be adjusted by application of a screwdriver applied to the slots 74. These sight pins may be either rigid pins, which can be pivoted into the arcuate, or otherwise, setting configuration, as shown in FIG. 3, or they may be of the flexible type, as previously explained in my U.S. Pat. No. 4,819,611. These are just examples of alternative types of sighting means, or sight pins, that may be used in conjunction with the adjustable sighting means of this invention, in order to provide for accuracy and precision in the adjustment made to the bow, through its sighting means, so as to assure further accuracy in the usage of the bow when sighting upon a target, in preparation for discharge of its arrow.

Variations or modifications to the subject matter of this invention may occur to those skilled in the art upon reviewing the disclosure as made herein. Such variations, if within the spirit of this invention, are intended to be encompassed within the scope of any claims to patent protection issuing upon this development. The description of the preferred embodiment as set forth herein is done so primarily for illustrative purposes only.

Having thus described the invention what is claimed and desired to be secured by Letters Patent is:

1. Means for temporarily holding sight pins in a preliminarily adjusted setting within a sight for an archery bow, wherein said sight is supported upon the archery bow, comprising a slide means provided within the sight and subject to lineal movement, said sight pins being adjustably supported upon said slide means, each sight pin being separately mounted for adjustable setting within its supporting sight upon the slide means, a clamp supporting said sight pins to the said slide means, said clamp including means for temporarily holding the sight pins in position upon the slide means during their preliminary setting and before clamping into their fixed position, wherein said means for temporarily holding said sight pins comprising a strip of magnetic material provided for holding the sight pins into their preliminary adjusted setting temporarily until clamped into fixed position by operation of the said clamp.

2. A sighting device incorporating a sight for use with an archery bow for facilitating accurate sighting of a target, comprising, a support arm, said support arm adjustably connectable with the bow, a first adjustment member mounted to said support arm, said first adjustment member providing for one of vertical and lateral adjustment in the setting of the sight, a second adjustment member mounted to said first adjustment member and providing for the other of said vertical and lateral adjustment to the setting of the sight, indexing means operatively associated with both said first and second adjustment members to provide for a fine setting to the sight, sight pins provided within the sight to aid the user in focusing upon a target, fastening means provided in both the first and second adjustment members, and when operated providing for securement of the adjustment members into their adjusted settings, the first adjustment member including a mount, securing to one end of the support arm, a slide operatively associated with said mount, said slide capable of being maneuvered with respect to its mount through manipulation of its indexing means to provide for one of the adjusted settings to said first adjustment member, said second adjustment member including a second mount, said second mount being connected to the slide of the first adjustment member, said second adjustment member also including a second slide, said second slide being operatively associated with the second adjustment member mount, said second slide capable of being shifted into one of said adjusted settings, through manipulation of the indexing means operatively associated with the second adjustment member, and said sight pins being mounted to said second slide, each of the mounts of the first and second adjustment members including a turn screw, said turn screws for each adjustment member operatively associated with their respective slides, and the indexing means connecting with each of the turn screws, and the indexing member provided in each indexing means, whereby upon turning of each of the indexing members furnishing a lineal movement to the turn screws and providing an adjusted setting to each of the slides for focusing of the side sight pins, the sight pins being adjustable in the mounting within the sight, a clamp provided for supporting the sight pins to the second slide, means for providing a preliminary setting to the sight pins, and said clamp incorporating said means for holding the sight pins in position during their preliminary setting and before clamping into fixed position, whereby said means for holding the sight pins comprising a strip of magnetic material provided for holding the sight pins into their adjusted settings temporarily until clamped by means of the clamp.

* * * * *

UNITED STATES PATENT AND TRADEMARK OFFICE

CERTIFICATE OF CORRECTION

PATENT NO. : 5,072,716

DATED : December 17, 1991

INVENTOR(S) : Donald R. Sappington

It is certified that error appears in the above-identified patent and that said Letters Patent is hereby corrected as shown below:

Title page, item [73] Assignee: change, "Toxoric, Inc." to ---Toxonic, Inc.---.

Column 8, claim 2, line 17, change "side" to ---said---.

Column 8, claim 2, line 17, after "sight pins", and before the ",", insert ---of the sight, said sight having a guard surrounding the set sight pins---.

Signed and Sealed this

Thirtieth Day of March, 1993

*Attest:*

STEPHEN G. KUNIN

*Attesting Officer*

*Acting Commissioner of Patents and Trademarks*